US008842502B2

(12) United States Patent
Chatelain et al.

(10) Patent No.: US 8,842,502 B2
(45) Date of Patent: Sep. 23, 2014

(54) WATCH MOVEMENT PART

(75) Inventors: Christian Chatelain, Tramelan (CH); Grégory Schmidt, Pougny (FR)

(73) Assignee: Montres Tudor S.A., Geneva (CH)

( * ) Notice: Subject to any disclaimer, the term of this patent is extended or adjusted under 35 U.S.C. 154(b) by 389 days.

(21) Appl. No.: 13/367,722

(22) Filed: Feb. 7, 2012

(65) Prior Publication Data

US 2012/0201105 A1 Aug. 9, 2012

(30) Foreign Application Priority Data

Feb. 7, 2011 (EP) ..... 11405208

(51) Int. Cl.

| | |
|---|---|
| ***G04B 21/00*** | (2006.01) |
| ***G04B 23/00*** | (2006.01) |
| ***G04B 23/02*** | (2006.01) |
| ***G04B 21/06*** | (2006.01) |

(52) U.S. Cl.

CPC ..... *G04B 21/06* (2013.01); *G04B 23/026* (2013.01)

USPC ..... 368/243; 368/269

(58) Field of Classification Search

USPC ..... 368/72, 75, 243, 244, 265–271; 116/148, 152, 161, 162

See application file for complete search history.

(56) References Cited

U.S. PATENT DOCUMENTS

| | | | | |
|---|---|---|---|---|
| 377,558 | A * | 2/1888 | Halvorsen | 368/269 |
| 2,127,635 | A * | 8/1938 | Warshawsky | 368/270 |
| 3,381,466 | A | 5/1968 | Schneider | |
| 8,711,659 | B2 * | 4/2014 | Lauper et al. | 368/203 |
| 2008/0192585 | A1 * | 8/2008 | Corthesy et al. | 368/268 |

FOREIGN PATENT DOCUMENTS

| | | | |
|---|---|---|---|
| CH | 431393 | A | 9/1966 |
| CH | 700606 | A1 | 9/2010 |
| DE | 952066 | C | 11/1956 |
| EP | 1574917 | A2 | 9/2005 |

OTHER PUBLICATIONS

European Search Report of EP 11 40 5208, mailing date Jul. 28, 2011.

* cited by examiner

*Primary Examiner* — Vit W Miska

(74) *Attorney, Agent, or Firm* — Westerman, Hattori, Daniels & Adrian, LLP

(57) ABSTRACT

This watch movement part comprises a frame (1) bearing a striking work mechanism which comprises:

a motor member (10) kinematically linked with a striking work wheel (20), a striking work hammer (40), an anchor (30) with two pallets (31, 32) engaged alternately with said striking work wheel (20) and cooperating with said striking work hammer (40) to make it oscillate between a first position striking a resonant member (50) and a second position, and a limiting spring (60) defining said second position, and wherein the anchor (30) and the striking work hammer (40) form a single striking work member mounted to pivot on the frame (1).

11 Claims, 3 Drawing Sheets

WATCH MOVEMENT PART

BACKGROUND OF THE INVENTION

The present invention relates to a watch movement part comprising a frame bearing a striking work mechanism which comprises a motor member kinematically linked with a striking work wheel, a striking work member mounted to pivot on the frame and comprising an anchor attached to a striking work hammer, this anchor having two pallets engaged alternately with said striking work wheel to make said striking work hammer oscillate between a first position striking a resonant member and a second position defined by a limiting member.

The frequency of oscillation of the striking work hammer must be low enough for the sound to be able to be diffused when the gong of the striking work enters into resonance, but also to maximize the duration of the ringing.

A conventional striking work mechanism consists of a barrel engaged with a gearwheel attached to a striking work wheel designed to drive the striking work hammer. This hammer is cinematically attached to an anchor, the two noses or pallets of which slide alternately over the inclined flanks of the teeth of the striking work wheel when the latter is driven in rotation by the barrel, so that the hammer oscillates between a position in which it strikes the resonant member of the striking work and a second position defined by an abutment.

The frequency of oscillation of the hammer depends on the torque of the motor spring, on the inertia of the hammer, and on the tolerances of assembly of the different components. The slightest variation of one of these parameters affects the hammer strike rate and therefore the sound quality and the duration of the ringing. However, the dimensional tolerances, and those of assembly do not make it possible to obtain a repeatable strike rate, and there is no means for adjusting it.

Moreover, the weight of the hammer is chosen such that, in a given bulk, its inertia is as great as possible. This has the advantage, for a given motor torque, of obtaining a low strike frequency which allows for a better diffusion of the sound of the gong of the striking work. However, in this case, the strike rate of the hammer, and therefore the duration of the ringing and the quality of the sound, are all the more sensitive to the effect of gravity, and therefore to the orientation of the wristwatch.

Finally, this design induces, in the event of an impulse of the hammer towards the limiting abutment, two distinct shocks of the strike itself. The first shock originates from the impact of the hammer against this abutment and the second shock is provoked by the contact between the anchor and one of the teeth of the striking work wheel, which has the effect of producing a jerky ring accompanied by a spurious noise. One solution would be to eliminate the limiting abutment so that the hammer abuts against one of the teeth of the striking work wheel, but this design does not eliminate the spurious noise and risks producing premature wear of the striking work mechanism.

CH 431 393 has proposed a striking work mechanism which makes it possible to obtain either an automatic variation of the strike rate of the hammer during ringing, or a ringing with continuous rate. This mechanism has only two positions and it does not therefore allow an accurate adjustment of the strike frequency of the striking work hammer. It is, moreover, complicated and comprises a large number of parts. Furthermore, since the anchor is separate from the hammer, the chain of tolerances is thereby particularly important, resulting in a wide dispersion of the strike frequency of the striking work hammer.

CH 700 606 describes another striking work device in which the pivoting axis of the hammer passes through its center of gravity so as to render the mechanism less dependent on the orientation of the watch. This striking work mechanism does not, however, allow the strike frequency of the hammer to be adjusted, nor does it make it possible to reduce the spurious noise of the mechanism and the premature wear of the striking work mechanism.

To mitigate the shock between the hammer and the abutment which limits its displacement, the Vulcain V10-H2 Golden Voice movement includes an O-ring seal on the abutment which serves as a damping element. However, such a seal does not cancel the risk of having spurious noises appear. Also, the latter does not make it possible to adjust the strike rate of the striking work hammer.

SUMMARY OF THE INVENTION

The aim of the present invention is to remedy, at least partly, the abovementioned drawbacks.

To this end, the subject of the invention is a watch movement part comprising a frame bearing a striking work mechanism which comprises:

- a motor member kinematically linked with a striking work wheel,
- a striking work hammer,
- an anchor with two pallets engaged alternately with said striking work wheel and cooperating with said striking work hammer to make it oscillate between a first position striking a resonant member and a second position, and
- a limiting spring defining said second position,
- wherein the anchor and the striking work hammer form a single striking work member mounted to pivot on the frame.

Because the hammer is fixed to the anchor, or vice versa, so as to form only a single piece, the construction of the striking work part is simplified and the tolerance chain, shorter, makes it possible to obtain a more limited dispersion of the strike frequency of the striking work hammer. Obviously, the hammer and the anchor can be manufactured from a single piece.

Furthermore, the elastic nature of the limiting spring makes it possible to restore a large proportion of the energy absorbed during the elastic deformation of the spring by the hammer, and thus acts on the strike rate of the hammer.

Preferably, the limiting spring according to the invention is prestressed, which makes it possible to adjust the strike rate of the hammer. Furthermore, the limiting spring also serves as damper, which brings two advantages. On the one hand, the shock between one of the teeth of the striking work wheel and the anchor is attenuated, which reduces the spurious noise and reduces the wear of the mechanism. Also, the damping of the shock is proportional to the energy stored by the hammer. The more violent the shock, the more the shock is damped. Thus, the bounce effects of the anchor on the striking work wheel are attenuated, regardless of the orientation of the hammer in the field of gravity. This therefore has the consequence of limiting the effect of the position of the watch on the strike dynamic of the hammer, and therefore on the duration of the ringing and on the quality of the sound.

BRIEF DESCRIPTION OF THE DRAWINGS

Other advantages and specifics of the invention will become apparent in light of the detailed description which follows and which describes a preferred embodiment of the invention, illustrated schematically and by way of example, by the appended figures in which.

DETAILED DESCRIPTION OF PARTICULAR EMBODIMENTS

Figure 1:
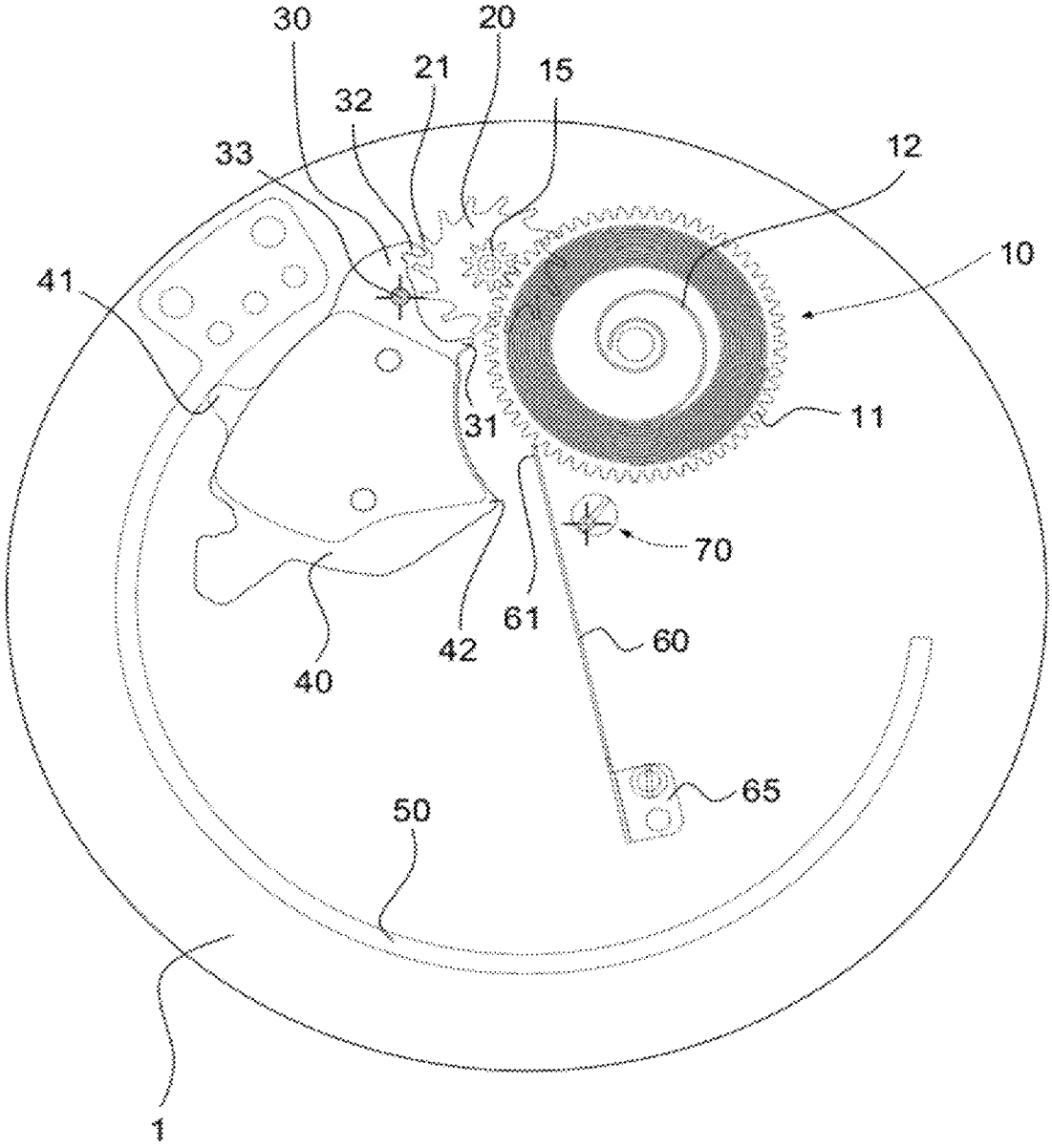
FIG. 1 is a simplified plan view of the main members of the striking work mechanism of a watch movement part according to the invention in which the striking work hammer is represented in its first position.

FIG. 1 represents a striking work mechanism mounted on a frame 1 forming the frame of the striking work part or of the additional module of the striking work part. This mechanism comprises a striking work barrel 10 comprising a drum surrounded by teeth 11. A motor spring 12 is housed inside the drum. The teeth 11 are engaged with a gearwheel 15 attached to a striking work wheel 20. The teeth 21 of this wheel alternately drive an anchor 30 mounted to oscillate about a pivoting axis 33. This anchor 30 is attached to a striking work hammer 40, which together form a striking work member.

The anchor is used to make the striking work hammer oscillate so that it periodically strikes a resonant member 50, in the case in point, a striking work gong.

To this end, this anchor has two noses or pallets 31, 32, against which the teeth 21 of the striking work wheel 20 slide alternately when it is driven in rotation by the motor member 10, thus making the anchor 30, and consequently the striking work hammer 40, oscillate.

The fact that the anchor 30 and the hammer 40 form a single member reduces the number of assembled elements of which the striking work mechanism consists. This striking work member combining the anchor 30 and the hammer 40 reduces the chain of tolerances, but does not however make it possible to significantly minimize the dispersion of the strike frequency of the hammer on the gong.

Figure 2:
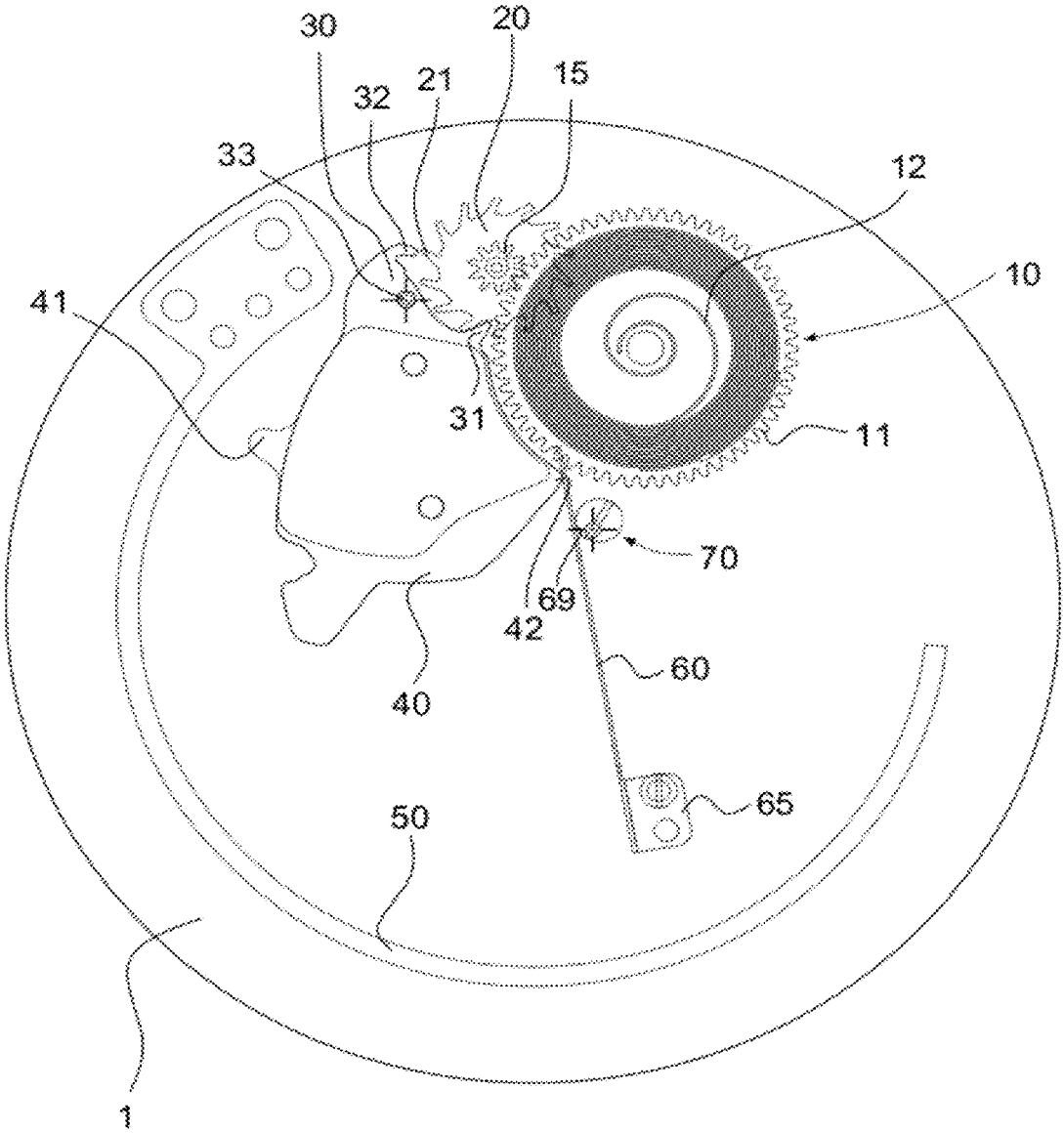
FIG. 2 is a view similar to that of FIG. 1, illustrating the striking work hammer in its second position.

FIGS. 1 and 2 illustrate the two limit positions of the hammer 40 during its oscillating movement about the axis 33. In FIG. 1, the hammer 40 occupies a first position in which a part 41 of the hammer strikes the gong 50 to make it vibrate. The second position of the hammer 40 illustrated by FIG. 2 is that in which a heel 42 of the hammer comes into contact with a limiting spring 60.

Preferably, the limiting spring 60 is prestressed against a bearing surface 69, preferably adjustable. The limiting spring advantageously consists of a spring blade which is fixed to the frame 1 by one of its ends, for example by embedding said end using a fixing member 65 and whose free end 61 constitutes the part used to limit the travel of the hammer 40 in an elastic manner. In practice, the heel 42 of the hammer 40 is intended to come into contact with the spring 60, between the free end 61 of the spring blade and the point at which this blade bears against the bearing surface 69.

In this example, the length of the blade of the limiting spring 60 is of the order of 12 mm and its section is of the order of 0.65×0.1 mm. The distance that separates the fixing member 65 from the bearing surface 69 is approximately 9 mm.

Figure 3A:
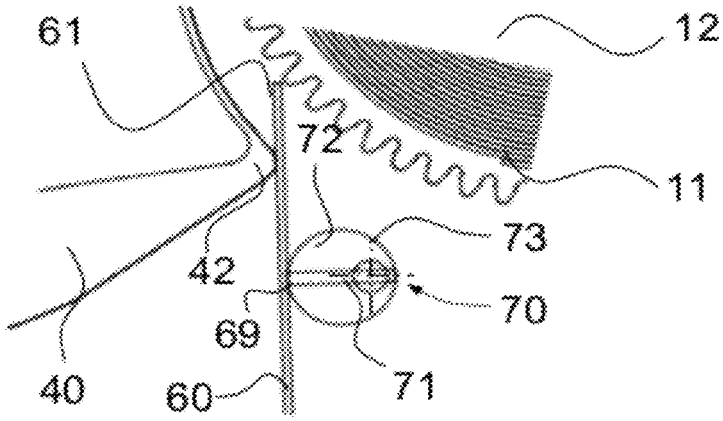
FIGS. 3*a*, 3*b* and 3*c* are detailed views in three different adjustment positions of the limiting spring of the striking work hammer.
Figure 3B:
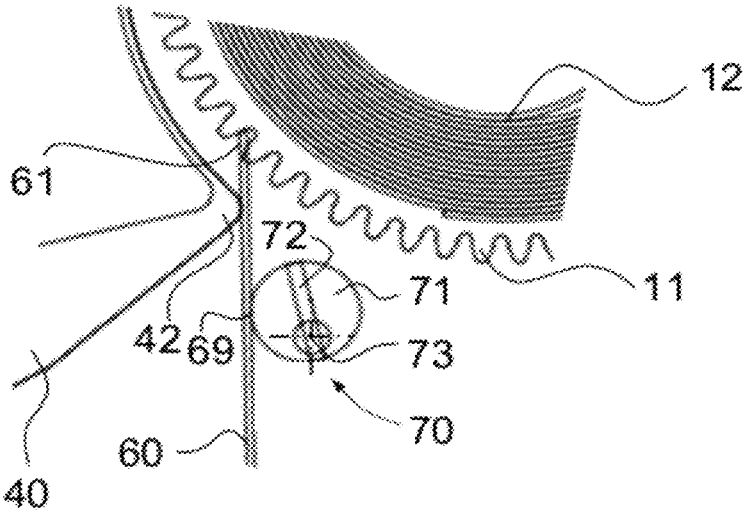
Figure 3C:
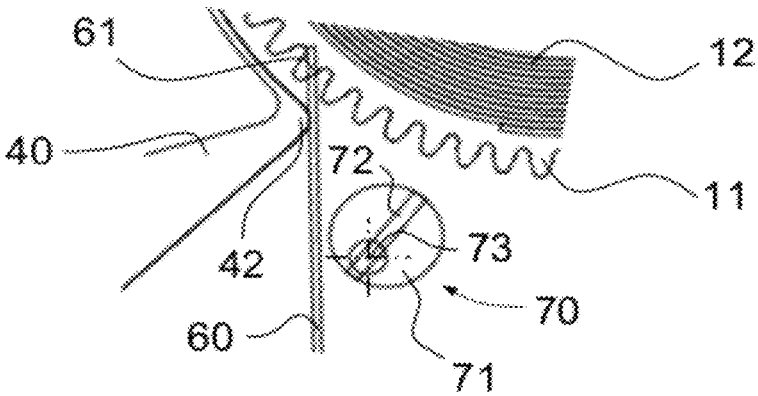

According to the preferred embodiment illustrated in FIGS. 3*a*, 3*b* and 3*c*, the bearing surface 69 consists of the lateral face of a prestressing member 70, for example taking the form of an adjustment eccentric 71 whose top face has a diametral gripping slot 72 to allow its angular position, and therefore the prestressing of the blade of the limiting spring 60, to be adjusted using a screwdriver.

In FIG. 3*a*, the eccentric 71 has been turned into the position in which the part of its lateral surface furthest away from the rotation axis is in contact with the blade of the limiting spring 60. The deflection of the latter is therefore maximum, typically of the order of 0.7 mm, in the case in point equal to 0.67 mm.

In FIG. 3*b*, the eccentric 71 is adjusted to an intermediate position, so that the deflection of the blade of the limiting spring 60 is typically of the order of 0.3 mm, in the case in point equal to 0.33 mm.

In FIG. 3*c*, the eccentric 71 has been turned so that the bearing surface 69 is no longer in contact with the blade of the limiting spring. The result of this is that the latter is then no longer armed and does not undergo any mechanical stress in this position.

When the heel 42 of the hammer 40 arrives in contact with the limiting spring 60, the latter undergoes a more or less significant deflection. This deflection is dependent on the one hand on the mechanical energy of the hammer on its arrival in its second position and on the other hand on the prestressing exerted on the blade of the limiting spring 60. This spring 60 serves as damper and attenuates the shock resulting from the contact between one of the teeth 21 of the striking work wheel and the nose 31 of the anchor, which reduces the spurious noise and the wear of the mechanism. The damping of the shock is proportional to the mechanical energy of the hammer. The result of this is that the bounce effects of the anchor on the striking work wheel are reduced, regardless of the orientation of the hammer in the field of gravity. The influence of the spatial position of the watch on the strike dynamic of the hammer is thus limited, which improves the regularity of the strike, the duration of the ringing and its sound quality.

When the hammer passes from its second position to its first position, the energy restored by the limiting spring 60 is added to the impulse transmitted to the anchor by the striking work wheel to displace the hammer against the gong. The restored energy speeds up the hammer in its displacement toward the resonant member and thus influences the strike rate. This reciprocating movement of the hammer is performed as long as the striking work is not stopped or as long as the barrel spring is not disarmed.

Tables 1 and 2 group together the results of the values obtained in tests carried out in a laboratory to measure the operating duration of the striking work, respectively, the strike frequency of the hammer according to two variable parameters. The invariable values which characterize the mechanism tested are as follows:

maximum torque of the barrel spring 12: 3.3 mN·m
maximum torque of the striking work wheel 20: 0.55 mN·m
inertia of the hammer 40: 83 g·mm$^2$
section of the blade of the spring 60: 0.65 mm×0.1 mm
active length of the blade of the spring 60: 12 mm Table 1 gives the duration in seconds of the ringing according to the two abovementioned variable parameters. The first parameter corresponds to the prestressing value of the limiting spring 60 which, in the present case, is reflected in the three positions of the bearing surface 69 of the eccentric 71 in FIGS. 3*a*, 3*b* and 3*c*, that can be compared to the behavior of a mechanism without limiting spring, but with fixed abutment. The second paragraph is that of the orientation of the watch movement part in the space according to five different positions. The positions of the watch CH, 3H, 9H, 12H and 6H correspond to the orientation of the striking work mechanism as it appears when the watch movement part is respectively arranged in a horizontal plane, dial uppermost, then in a vertical plane in which the hour FIG. 3 of the dial, then the FIG. 9, the FIG. 12 and finally the FIG. 6 point to the zenith.

TABLE 1

| Duration [s] | CH | 3H | 9H | 12H | 6H | Average | Dispersion (3*sigma) |
|---|---|---|---|---|---|---|---|
| Adjustment 1 | 10.1 | 10.7 | 9.9 | 10.1 | 10.5 | 10.3 | 1.0 |
| Adjustment 2 | 12.2 | 12.5 | 12.7 | 12.8 | 13.7 | 12.8 | 1.6 |
| Adjustment 3 | 16.1 | 14.5 | 18.8 | 16.1 | 15.9 | 16.3 | 4.7 |
| Without abutment | 15.9 | 14.6 | 18.3 | 16.3 | 15.8 | 16.2 | 4.1 |

The second table gives the values of the strike frequency of the hammer according to the same parameters as those described previously.

TABLE 2

| Strike frequency [Hz] | CH | 3H | 9H | 12H | 6H | Average | Dispersion (3*sigma) |
|---|---|---|---|---|---|---|---|
| Adjustment 1 | 66.0 | 61.4 | 64.3 | 63.7 | 60.8 | 63.2 | 6.4 |
| Adjustment 2 | 55.3 | 52.1 | 52.8 | 52.8 | 49.1 | 52.4 | 6.7 |
| Adjustment 3 | 41.5 | 45.5 | 39.0 | 42.8 | 42.6 | 42.3 | 7.1 |
| Without abutment | 40.0 | 46.0 | 37.8 | 41.2 | 43.2 | 41.6 | 9.4 |

From table 1, it can be seen that the angular position of the adjustment eccentric 71 and therefore the value of the prestressing directly influences the duration of the ringing. The greater the reaction force of the limiting spring, the shorter the ringing duration. This is explained by the fact that the reaction force exerted on the striking work hammer 40 is added to the impulse imparted by the striking work wheel 20 and results in an accelerated uncoiling of the barrel spring 12. Table 2 shows that that is naturally reflected in a higher strike rate.

As for the second parameter, it shows that the prestressing of the limiting spring 60 has the effect of reducing the influence of gravity on the striking work mechanism. The greater the reaction force of the limiting spring, the less sensitive the striking work mechanism is to the position variations in space. This is explained by the fact that the limiting spring contributes on the one hand to launching back the hammer and on the other hand acts as a damper for the anchor against the striking work wheel, which makes it possible to obtain a more uniform strike frequency in the different spatial positions.

Table 1 shows that the dispersion of the ringing duration is close to five times greater when the limiting spring 60 is not prestressed than when it is subjected to a maximum prestressing in accordance with FIG. 3*a*.

Although the association of an eccentric to adjust the position of the bearing surface 69 corresponds to the preferred embodiment of the invention, any other adjustment system, for example screw-based, allowing a measured displacement and an immobilizing of a surface capable of defining an adjustable bearing position can be used. Similarly, although in the example illustrated the bearing surface 69 is situated on the eccentric 71, this bearing surface could be on another part separate from the eccentric and kinematically linked thereto.

By virtue of the subject of the present invention, the dispersion of the strike frequency of the striking work hammer is reduced and it becomes not only possible to adjust the duration of the ringing by adjusting the strike frequency of the hammer via the adjustment means, but also to obtain a striking work mechanism which is less sensitive to the orientation of the watch in space and does not interfere with the sound emitted by the resonant member. Furthermore, the limiting spring makes it possible to reduce the risk of shearing of the pivoting axis of the anchor 33 and to avoid premature wear of the striking work mechanism.

The invention claimed is:

1. A watch movement part comprising a frame bearing a striking work mechanism which comprises:

a motor member kinematically linked with a striking work wheel, a striking work hammer, an anchor with two pallets engaged alternately with said striking work wheel and cooperating with said striking work hammer to make it oscillate between a first position striking a resonant member and a second position, and a limiting spring defining said second position, wherein the anchor and the striking work hammer form a single striking work member mounted to pivot on the frame.

2. The watch movement part as claimed in claim 1, in which said limiting spring is associated with a prestressing member.

3. The watch movement part as claimed in claim 1, in which said prestressing member comprises or is kinematically attached to a prestress adjustment member.

4. The watch movement part as claimed in claim 1, in which said limiting spring is a blade embedded at one end, bearing against said prestressing member between its embedded end and the point of contact of this blade with said striking work hammer.

5. The watch movement part as claimed in claim 2, in which said prestressing member comprises or is kinematically attached to an adjustment eccentric having a diametral gripping slot.

6. The watch movement part as claimed in one of claim 2, in which said prestressing member comprises or is kinematically attached to a prestress adjustment member.

7. The watch movement part as claimed in claim 2, in which said limiting spring is a blade embedded at one end, bearing against said prestressing member between its embedded end and the point of contact of this blade with said striking work hammer.

8. The watch movement part as claimed in claim 3, in which said limiting spring is a blade embedded at one end, bearing against said prestressing member between its embedded end and the point of contact of this blade with said striking work hammer.

9. The watch movement part as claimed in claim 6, in which said limiting spring is a blade embedded at one end, bearing against said prestressing member between its embedded end and the point of contact of this blade with said striking work hammer.

10. The watch movement part as claimed in claim 3, in which said prestressing member comprises or is kinematically attached to an adjustment eccentric having a diametral gripping slot.

11. The watch movement part as claimed in claim 6, in which said prestressing member comprises or is kinematically attached to an adjustment eccentric having a diametral gripping slot.

* * * * *